United States Patent [19]

Ishii et al.

[11] Patent Number: 4,691,631

[45] Date of Patent: Sep. 8, 1987

[54] CYLINDER SETTING MECHANISM FOR AN OFFSET PRINTING MACHINE

[75] Inventors: Koji Ishii; Yukito Okuda, both of Hiroshima, Japan

[73] Assignee: Ryobi Ltd., Hiroshima, Japan

[21] Appl. No.: 844,031

[22] Filed: Mar. 25, 1986

[30] Foreign Application Priority Data

Mar. 26, 1985 [JP] Japan ..... 60-63130

[51] Int. Cl.[4] ..... B41F 13/20; B41F 13/28

[52] U.S. Cl. ..... 101/218; 101/177

[58] Field of Search ..... 101/218, 217, 247, 137, 101/140, 143, 144, 145, 177, 184, 185, 232, 233, 234

[56] References Cited

U.S. PATENT DOCUMENTS 2,578,700 12/1951 Harrold et al. ..... 101/218

2,909,117 10/1959 Crissy ..... 101/217 X

FOREIGN PATENT DOCUMENTS 3318316 12/1983 Fed. Rep. of Germany ..... 101/218

*Primary Examiner*—J. Reed Fisher

*Attorney, Agent, or Firm*—Sughrue, Mion, Zinn, Macpeak & Seas

[57] ABSTRACT

A cylinder setting mechanism for an offset printing machine effects setting of a rubber blanket cylinder into peripheral contact with an impression cylinder and the plate cylinder sequentially. Eccentric metal parts are rotatably mounted for rotation on laterally spaced frame vertical walls for rotation about a first axis and rotatably mount an eccentric rubber blanket cylinder shaft for rotation about a second eccentric axis. The eccentric rubber blanket cylinder shaft rotatably mounts the rubber blanket cylinder eccentrically about a third axis eccentric to the axis of rotation of the shaft. A plate cylinder setting cam and an impression cylinder setting cam are fixedly secured to the impression cylinder rotate therewith and are angularly offset. A plate cylinder setting mechanism includes a first toggle mechanism coupled to the eccentric metal part and a plate cylinder setting mechanism striking bar operatively positioned with respect to the plate cylinder setting cam and coupled to the first toggle mechanism cause the rubber blanket cylinder to be brought into and out of engagement with the plate cylinder. An impression cylinder setting mechanism includes a second toggle mechanism coupled to the eccentric rubber blanket cylinder shaft and an impression cylinder setting mechanism striking bar operatively positioned with respect to the impression cylinder setting cam and responsive thereto is coupled to the second toggle mechanism.

4 Claims, 3 Drawing Figures

CYLINDER SETTING MECHANISM FOR AN OFFSET PRINTING MACHINE

This application relates to U.S. application Ser. No. 843,415, filed Mar. 24, 1986, entitled PLATE PRESSURE AND PRINTING PRESSURE ADJUSTING MECHANISM FOR OFFSET PRINTING MACHINES, and assigned to the common assignee.

FIELD OF THE INVENTION

This invention relates to an offset printing machine and more particularly to a cylinder setting mechanism for such printing machine.

BACKGROUND OF THE INVENTION

Conventional cylinder setting mechanisms for offset printing machines are so designed that the rubber blanket cylinder is brought into or out of engagement with the plate cylinder and the impression cylinder simultaneously. As a result, there can be no transfer of the plate image onto the rubber blanket cylinder before printing. In order to confirm the plate image and the suitable transfer of the plate image onto the rubber blanket cylinder and in turn onto a sheet carried on the periphery of the impression cylinder, it is necessary to use a number of sheets which are "spoiled" in the process of making the transfer and by the use of certain adjustments to finally produce a transfer image which is satisfactory. Furthermore, since the setting or releasing of the rubber blanket cylinder is carried out when the cut of the respective cylinders are not in alignment with each other, the image is not uniform in density at the start of the printing operation.

It is, therefore, an object of the present invention to provide a cylinder setting mechanism for an offset printing machine which is capable of setting the rubber blanket cylinder in contact with respect to the plate cylinder and the impression cylinder individually and in two steps and to perform the setting or releasing of the rubber blanket cylinder when the cuts of the respective cylinders are aligned with each other, permitting the plate image to be transferred onto the rubber blanket cylinder for checking prior to printing and the setting of the rubber blanket cylinder relative to the plate cylinder and the impression cylinder can be controlled separately during the printing operation eliminating the necessity to use spoil sheets and wherein the image is free from nonuniform density and wherein satisfactory prints may be obtained beginning with the first print.

SUMMARY OF THE INVENTION

The present invention is directed to a cylinder setting mechanism for an offset printing machine. The offset printing machine comprises laterally spaced frame vertical walls, an impression cylinder mounted between the walls for rotation horizontally about a fixed axis on the frame, a plate cylinder mounted for rotation between the walls about a second fixed axis parallel to the axis of the rotation of the impression cylinder with the periphery of the plate cylinder and the impression cylinder spaced from each other. A rubber blanket cylinder is interposed between the pressure cylinder and the plate cylinder, parallel thereto and between the frame vertical walls for peripheral contact with the plate cylinder and the impression cylinder. The improvement comprises eccentric metal parts rotatably mounted on respective frame vertical walls for rotation about a first axis. An eccentric rubber blanket cylinder shaft extends between the frame vertical walls and is mounted on said eccentric metal parts for rotation on said parts, about an axis eccentric to the axis of rotation. Said eccentric rubber blanket cylinder shaft includes eccentric means for mounting said rubber blanket cylinder for rotation on the rubber blanket cylinder shaft about an axis which is eccentric to the axis of rotation of the eccentric rubber blanket cylinder shaft. Means are provided for selectively, sequentially rotating eccentric metal parts and said eccentric rubber blanket cylinder shaft for sequentially setting the rubber blanket cylinder into engagement initially with the plate cylinder and subsequently with the impression cylinder in two steps.

The means for effecting selective sequential setting of the rubber blanket cylinder into engagement with the plate cylinder and the impression in two steps comprises a plate cylinder setting cam and an impression cylinder setting cam fixedly secured to the impression cylinder and rotating therewith and being angularly offset; and a plate cylinder setting mechanism and an impression cylinder setting mechanism operatively positioned with respect thereto. The plate cylinder setting mechanism has a cylinder pressure adjusting mechanism including a first toggle mechanism coupled to the eccentric metal part. A plate setting cylinder striking bar is operatively positioned with respect to the plate cylinder setting cam and coupled to said first toggle mechanism such that the rubber blanket cylinder is brought into and out of engagement with the plate cylinder in response to the contact of the plate cylinder setting cam and said plate cylinder setting mechanism striking bar. The impression cylinder setting mechanism has a second cylinder pressure adjusting mechanism including a second toggle mechanism coupled to the eccentric rubber blanket shaft and an impression cylinder setting mechanism striking bar is operatively positioned with respect to the impression cylinder setting cam and coupled to the second toggle mechanism whereby the rubber blanket cylinder is brought into engagement with the impression cylinder individually.

The plate cylinder setting mechanism further comprises a printing machine operating shaft extending between the frame vertical walls and mounted for rotation about its axis parallel to the axis of rotation of said cylinder. A operating cam is fixedly mounted to the operating shaft and rotates therewith. A cam follower means operatively coupled to the plate cylinder setting mechanism first toggle mechanism and positioned in the path of the radial cam and responsive to operating shaft rotation sets the rubber blanket cylinder in contact with the plate cylinder without detection of a printing sheet such that accordingly, the amount of ink to be transferred on to the rubber blanket cylinder from the plate cylinder may be adjusted prior to initiation of printing operation with satisfactory prints obtained beginning with the first desired print.

The impression setting mechanism comprises a solenoid energizable in response to detection of a printing sheet supplied to the impression cylinder and the solenoid includes an axially movable plunger. A cylinder setting arm of the impression setting mechanism is coupled to the striking bar of the plate cylinder setting mechanism through the coupling link. The coupling link is slidably mounted at one end to the center of a link boss fixed to the impression cylinder setting mechanism striking bar and compression springs concentrically surround the striking bar on opposite sides of the link boss with spring retainers mounted on the link and abutting the ends of said springs remote from the link boss to maintain the springs in symmetrical compression. The coupling link has its opposite end operatively connected to the solenoid plunger whereby the rubber blanket cylinder is set into engagement with the plate cylinder prior to being set into engagement with the impression cylinder, unpon solenoid energization and wherein the de-energization of the solenoid results in automatic retraction of the rubber blanket cylinder from the impression cylinder and from the plate cylinder.

DESCRIPTION OF THE PREFERRED EMBODIMENT

Figure 1:
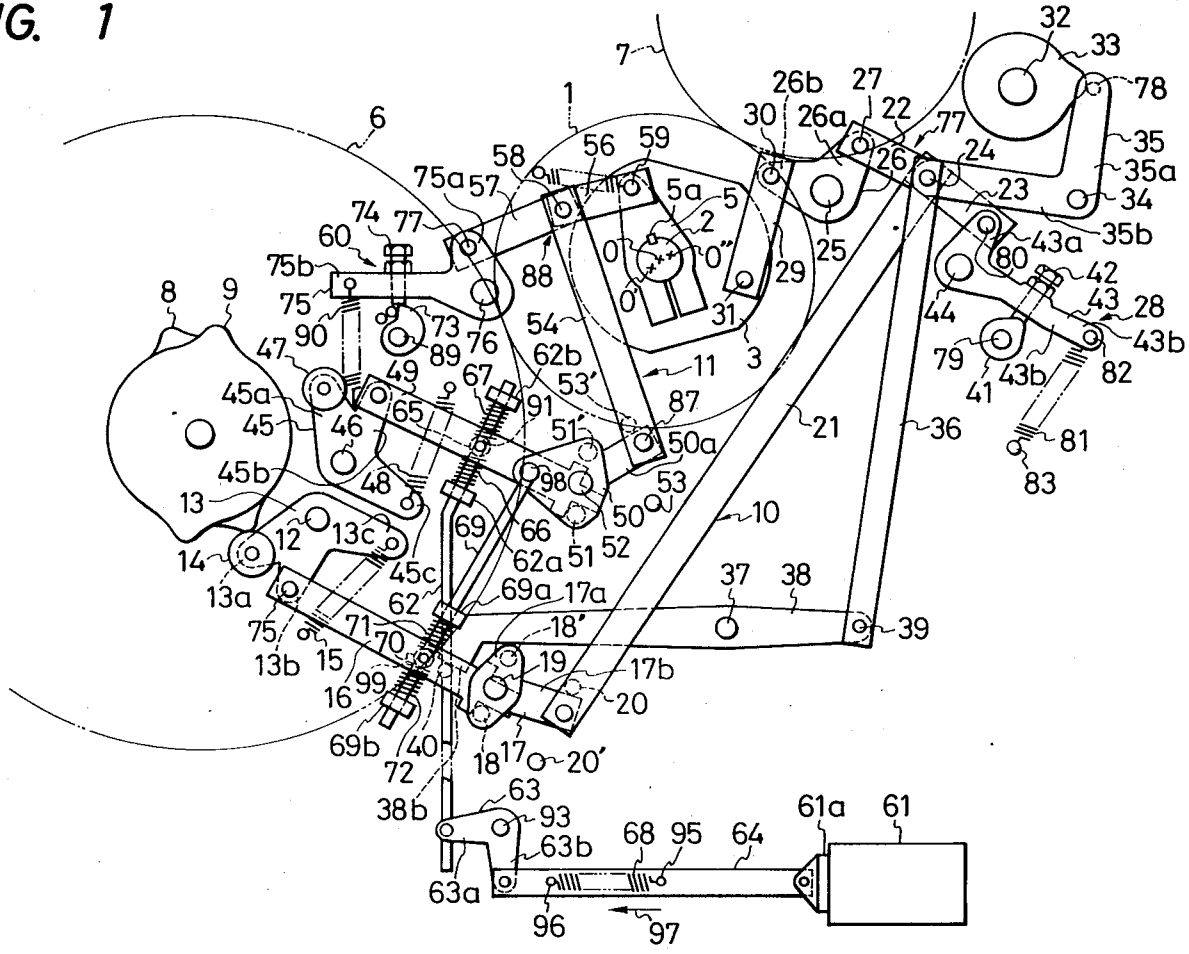
FIG. 1 is a schematic front view of a cylinder setting mechanism for a offset printing machine and forming a preferred embodiment of the invention.
Figure 2:
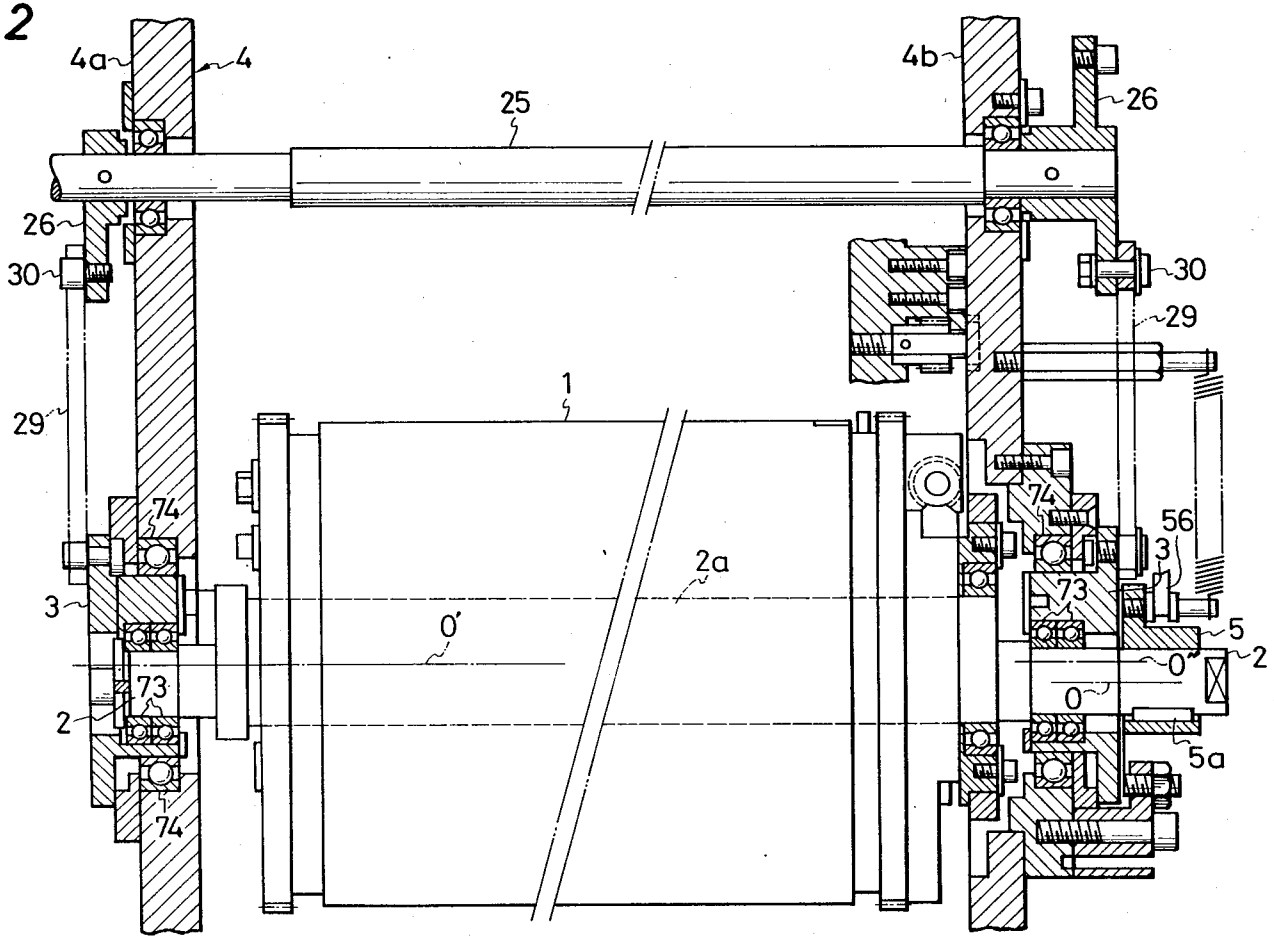
FIG. 2 is an unfolded section of a part of the cylinder setting mechanism illustrated in FIG. 1.

A preferred embodiment of the invention will be described with reference to the accompanying drawings. As shown in FIGS. 1 and 2, a rubber blanket cylinder 1 is supported on laterally opposed vertical walls of a frame 4 for rotation about the axis of the rubber blanket cylinder 1, by means of an eccentric rubber blanket cylinder shaft 2. In that respect, the rubber blanket cylinder 1 is rotatably supported on eccentric portion 2*a* of the eccentric rubber blanket cylinder shaft 2 for rotation about its axis O″. The eccentric rubber blanket cylinder shaft 2 rotates about an axis O, FIG. 2, supported for that rotation by double pairs of ball bearings 73 carried by eccentric metal parts 3. In turn, the eccentric metal parts 3 are mounted for rotation about axis O′ by ball bearings 74 to both sides of the printing machine carried by laterally spaced vertical walls 4*a*, 4*b* of the frame 4, FIG. 2. Arm 5, FIG. 2, is fixedly keyed to shaft 2 by key 5*a*, and extends radially from the eccentric rubber blanket cylinder shaft 2. The eccentric rubber blanket cylinder shaft 2 and eccentric metal parts 3 are rotated individually by an impression cylinder setting mechanism as indicated generally at 11, FIG. 1, and a plate cylinder setting mechanism indicated generally at 10, FIG. 1 (both described hereinafter) so that the rubber blanket cylinder 1 is brought into and out of engagement with impression cylinder 6 and plate cylinder 7 individually and in two steps. Certain of the components on one side of the machine and in juxtaposition to one of the vertical walls 4*a* of the frame 4 have exact correspondence at the opposite lateral vertical wall 4*a* of that frame as will be described hereinafter and which may be readily appreciated by viewing the drawings.

As seen best in FIG. 1, a plate cylinder setting cam 8 and an impression cylinder setting cam 9, which are similar in configuration, are provided on the sidewall of the impression cylinder 6 and are angularly offset such that the cams 8 and 9 provide different timing as a result of being shifted relative to each other in the direction of rotation. The plate cylinder setting mechanism 10 and the impression cylinder setting mechanism 11 are operated individually by the cams 8 and 9, respectively, and in turn are coupled mechanically to the eccentric metal parts 3 and arm 5, respectively.

With respect to the plate cylinder setting mechanism 10, an arm 13, FIG. 1 is pivotally mounted, near its center, on a stud shaft 12 which is embedded in frame 4 and is provided with three radially projecting and angularly offset portions 13*a*, 13*b* and 13*c*. Portion 13*a* pivotally mounts a bearing or rotatable cam follower 14 adjacent the end thereof remote from the arm pivot axis defined by stud shaft 12. Portion 13*c* of the arm 13 is connected to one end of the tension spring 15, the opposite end which is fixed to frame 4. Thus, the tension spring 15 brings bearing 14 in contact with the periphery of cam 8. The radial projection or portion 13*b* of arm 13 is pin connected via pin 75 to one end of a striking bar 16. Further, a T-shaped arm 17 is pivotally mounted at the center of its base 17*a* to frame 4 and has projecting outwardly from the base 17*a* at opposite ends thereof, pins 18 and 18′ which are in a position to be struck by the end of striking bar 16. Center projection 17*b* of the T-shaped arm 17 is pin connected by pin 76 to one end of actuator link 21. Further, a pair of stoppers 20 and 20′ are fixedly mounted to frame 4, and limit the pivoting of arm 17 which pivoting is caused by striking bar movement. The other end of actuating link 21 is pin connected via pin 24 to a pair of toggle links 22, 23, whose one ends are commonly pivotally connected to the actuator link 21. Further, one of the toggle links 22 is pin connected via pin 27 to the outboard end of one right angle portion 26*a* of arm 26, arm 26 being pivotally mounted on a shaft 25 which extends between the frame vertical walls 4*a*, 4*b*. The other end of toggle link 23 is pivotally coupled to a cylinder pressure adjusting arm 43 of cylinder pressure adjusting mechanism 28 for the rubber blanket cylinder 1 acting on the plate cylinder 7. Actuator link 21 and toggle links 22 and 23 form a toggle mechanism indicated generally at 77. Further, right angle portion 26*b* of arm 26 at its outboard end is pin connected via pin 30 to a link 29, the opposite end of the link 29 being pin connected via pin 31 to eccentric metal part 3 at some point outwardly of the pivot axis O″ for the eccentric metal part 3. In that respect, as seen in FIG. 2, paired links 29 are employed to the opposite sides of the machine as are eccentric parts 3 and arms 26, with arms 26 being suitable fixed to opposite ends of shaft 25.

Insofar as the plate cylinder setting mechanism 10, described above, is concerned, it is operated in association with operating shaft 32 of the printing machine, FIG. 1, so that its operation is periodically effected in response to the action of at least one radially projecting radial cam 33 fixedly mounted to shaft 32.

In that respect, an L-shaped operating arm 35 is pivotally mounted on a stud shaft 34 embedded in frame 4, the arm 35 carrying at the end of one portion 35*a*, a cam follower or pin 78 which abuts the periphery of the radial cam 33 while, the right angle arm portion 35*b* is pivotally coupled via pin 24 to operating link 36 as well as actuator link 21 and toggle links 22, 23 of toggle mechanism 77. The other end of operating link 36 is pivotally coupled via pin 39 to one end 38*a* of arm or lever 38. Arm or lever 38 is pivotally mounted, intermediate of its ends via pin 37 to frame 4. The other end of 38*b* of arm 38 abuts against a pin 40 which is embedded in the side of striking bar 16, the effect of which is to cause the striking bar 16 to pivot clockwise about its pin connection 75 to arm 13 in response to counterclockwise rotation of arm 38 about pin 37.

As a result thereof, it is possible to set the rubber blanket cylinder 1 relative to the plate cylinder 7 without the need of detecting the presence of a printing sheet on impression cylinder 6. Accordingly, the amount of ink to be transferred onto the rubber blanket cylinder 1 can be adjusted before actual printing operation and, therefore, satisfactory prints may be obtained beginning with the first desired print on the initial print sheet supplied to the impression cylinder 6.

Further, with respect to the cylinder pressure adjusting mechanism 28, a radial cam 41 fixably mounted for rotation on a shaft 79 and its periphery abuts the threaded end of an adjusting screw 42 which is threaded to adjusting arm 43, and whose threaded end and projects from an adjusting arm 43. The adjusting arm 43 is pivotally mounted so as to rotate about the axis of a stud shaft 44 fixed to frame 4. Adjusting arm 43 is of modified L-shape with one portion 43*a* being pin connected via pin 80 to the toggle link 23 at its end remote from pin 24. A tension spring 81 is fixed at one end to a stud 83 fixed to frame 4 while its opposite end is connected via a hole, pin or the like 82 to the outboard end of adjusting arm portion 43*a* beyond that portion bearing the adjusting screw 42. The tension spring 81 maintains the threaded end of the adjusting screw 42 in contact with the periphery of radial cam 41. Rotation of the adjusting arm 43 changes the angle of the eccentric metal part 3 through the toggle mechanism 77 via toggle links 23, 22, arm 26 and link 29, thereby adjusting the printing sheet pressure.

Turning next to the impression setting mechanism 11, an arm 45, which has three radially projecting portions or fingers 45*a*, 45*b* and 45*c*, is pivotally mounted on stud shaft 46 which shaft is embedded in frame 4. A bearing or rotary cam follower 47 is rotatably mounted to one end of arm portion or finger 45*a* and is positioned so as to come into abutment with impression cylinder setting cam 9 during rotation of that cam as a result of the impression cylinder 6 rotation on its shaft 84. A tension coil spring 48 has one end coupled to the finger or arm portion 45*c* while its opposite end is fixed to the frame as by way of pin or like connection 85. The spring 48 tends to rotate the arm 45 counterclockwise so as to maintain contact between the bearing 47 or cam follower and the periphery of the impression cylinder setting cam 9. One end of a striking bar 49 is pivotally connected to the finger or arm portion 45*b* of arm 45, via pin 86.

A cylinder setting arm 50 is pivotally mounted on a stud shaft 52 which is embedded in frame 4 and the cylinder setting arm 50 carries a pair of right angle projecting pins 51, 51', which are spaced apart and positioned on opposite sides of striking bar 49 at its end remote from pin 86. Further, in like fashion to striking bar 16, a pair of stops 53, 53', are positioned on opposite sides of an oblique projection 50*a* which extends from the cylinder setting arm 50 and is integral therewith so as to limit pivotal movement of the cylinder setting arm 50 as a result of striking action by striking bar 49 against either pin 51 or 51' carried by the cylinder setting arm 50. Further, the outboard end of projection 50*a* is pin connected via pin 87 to one end of actuator link 54, the opposite end of the actuator link 54 being pin connected commonly by pin 58 to the ends of toggle links 56, 57. In that respect, the actuator link 54 and toggle links 56, 57 form a second toggle mechanism indicated generally at 88.

Toggle link 56 is pin connected via pin 59 to arm 5, at its end remote from its pin connection to actuator link 54. Toggle link 57 is pin connected via pin 77 to a cylinder pressure adjusting arm 75 of a cylinder pressure adjusting mechanism indicated generally at 60. This cylinder pressure adjusting mechanism 60 is employed for the impression cylinder in contrast to a similar mechanism 28 for the plate cylinder 7. Adjusting arm 75 is pivotally mounted via stud shaft 76 to frame 4 at the intersection of adjusting arm portions 75*a*, 75*b*. An adjustment screw 74 is threaded into and through the adjusting arm portion 75*b* so that its threaded ends abuts the periphery of a radial cam 73 which is fixed to a shaft 89 which in turn is rotatably mounted to frame 4. By rotation of shaft 89, the periphery of the radial cam 73 shifts relative to the end of the threaded adjusting screw 74 which abuts that periphery or cam face of radial cam 73. Further, a tension coil spring 90 has one end fixed to the frame 4 and its opposite end connected to the end of arm portion 75*b* to the side of the adjusting screw 74 remote form the pivot axis as defined by stud 76 tending to rotate arm 75 counterclockwise. Thus, spring tension is maintained on adjusting arm 75 to insure contact between the radial cam 73 and the adjusting screw 74.

A link boss 65 projects outwardly of the striking bar 49 intermediate of its ends and is provided with a transverse through hole 91 through which slidably passes a rod-like link 62. A pair of spring retainers 62*a* and 62*b* are mounted on the link 62. Spring 66 is compressed between the spring retainer 62*a* and the link boss 65, and compression coil spring 67 is compressed between the spring retainer 62*b* and link boss 65, thereby maintaining link 62 coupled to striking bar 49. Link 62 is bent intermediate of its ends, and the end of the link 62 remote from its connection to link boss 65 is pivotally coupled via pin 92 to the end of one portion 63*a* of an L-shaped arm 63, which arm 63 is pivotally mounted via stud 93 to frame 4. The end of the other right angle portion 63*b* of the L-shaped arm 63 is pin connected via pin 94 to a link 64 whose opposite end is connected to a solenoid plunger 61*a* of solenoid 61. A tension spring 68 is fixedly coupled to link 64 at one end via pin 95, with the opposite end of the coil spring being fixedly connected to frame 4 via a further pin 96 such that the arm 64 is biased in the direction of arrow 97.

Further, a coupling link 69 is pin connected via pin 98 at one end to the cylinder setting arm 50 and, its opposite end is connected to the striking bar 16 of the plate cylinder mechanism 10. In that respect, the end of the coupling link 69, which link 69 is of rod form, slidably passes through a transverse through hole 99 within a link boss 70 which is fixed to and projects outwardly of the striking bar 16. Spring retainer 69*a* and 69*b* are fixedly mounted to link 69 to opposite sides of the link boss 70 and compression coil springs 71 and 72 are concentrically mounted on the coupling link and are compressed respectively between link boss 70 and spring retainers 69*a* and 69*b*. The elastic force of the compression spring 72 is such that the cylinder setting arm 50 is not affected when the striking bar is pushed downwardly by counterclockwise rotation of arm 38 about its pivot axis as defined by pin 37. When the rubber blanket cylinder 1 is disengaged from the impression cylinder 6, the striking bar 16 is driven upwardly by clockwise rotation of the cylinder setting arm 50 about its pivot axis as defined by stud shaft 52, the result of which is that the rubber blanket cylinder 1 is shifted away from the plate cylinder 7.

Accordingly, after an ink form roller (not shown) is caused to touch the plate cylinder surface by operation of cam 33 of the operating shaft 32, the rubber blanket cylinder 1 may be set relative to plate cylinder 7 before the ink is transferred onto the first sheet to be printed.

With respect to cylinder pressure adjusting mechanism 60 for the impression cylinder 6, the arm 75 is pivoted about its pivot shaft 76 by angular rotation of radial cam 73 with the periphery of the cam driving the adjustment screw 74 axially against the bias of tension spring 90 so that the angle of arm 5 is shifted through the toggle mechanism 88 through toggle link 57, and toggle link 56, thereby adjusting the cylinder pressure between rubber blanket cylinder 1 and impression cylinder 6; that is, the sheet pressure acting on the print sheet carried by the impression cylinder 6 on its periphery.

As may be seen in FIG. 2, the arms 26 of the plate cylinder setting mechanism 26 are fixedly mounted to respective end portions of shaft 25 which project through the vertical walls 4*a*, 4*b* of the frame 4. Further, two eccentric metal parts 3 are rotatably mounted on frame vertical walls 4*a*, 4*b*, respectively. The eccentric metal parts 3 are coupled through links 29 to arms 26, respectively, to operate the rubber blanket cylinder 1 and adjust its position with a high degree of accuracy.

In the cylinder setting mechanism as so constructed, the striking bar 49 is actuated through arm 45 by the rotation of the impression cylinder setting cam 9 so that when the link 62 is held in the position as shown in FIG. 1. The cylinder setting arm 50 is operative with the amount of its operation regulated by stoppers 53 and 53'. Therefore, the actuator link 54 of toggle mechanism 88 is forced upwardly until the arm projection 50*a* contacts stopper 53', the result of which is to pivot arm 5 fixed to shaft 2 clockwise shifting the axis of rotation of the rubber blanket cylinder 1 relative to the impression cylinder 6 due to the eccentricity of the eccentric rubber cylinder shaft 2. In this operation, the links 54, 56 and 57 of the toggle mechanism 88 determine the extent of movement.

In engaging the rubber blanket cylinder 1 with the plate cylinder 7 or in disengaging cylinder 1 from that cylinder 7, pivoting of arm 13, movement of striking bar 16, pivoting of arm 17, longitudinal shifting of the actuator link 21 and pivoting of toggle links 22 and 23 are all caused by means of plate cylinder setting cam 8 in the same general manner as that employed in engaging the rubber blanket cylinder 1 with the impression cylinder 6 or disengaging the cylinder 1 from cylinder 6. In setting of the rubber blanket cylinder 1 relative to plate cylinder 7, the pair of links 29 are moved downwardly by rotation of arms 26 such that the eccentric metal parts 3, to opposite sides of the rubber blanket cylinder 7, are rotated with metal part 3 rotating clockwise, FIG. 1. As a result, the rubber blanket cylinder 1 is adjusted or set relative to plate cylinder 7 due to the eccentricity of the eccentric metal parts 3 with respect to the rubber blanket cylinder.

The eccentric positions of the eccentric rubber blanket cylinder shaft 2 and the eccentric metal parts 3 are so selected that, in setting the rubber blanket cylinder 1 relative to the impression cylinder 6 and in setting the rubber blanket cylinder 1 relative to plate cylinder 7, the cylinder pressure between the rubber blanket cylinder 1 and the plate cylinder 7 and the cylinder pressure between the rubber blanket cylinder 1 and the impression cylinder are not affected, respectively.

Solenoid 61 is energized when a sheet detecting device (not shown) detects a printing sheet on the periphery of the impression cylinder 6 causing the solenoid plunger 61a to move to the right, FIG. 4, in opposition to the spring bias as evidenced by arrow 97 stretching spring 68. This causes arm 63 to rotate counterclockwise so that link 62 is pulled downwardly and accordingly, the striker bar 49 is also pulled downwardly, pivoting about pivot pin 86 on arm 45. As a result, the rubber blanket cylinder 1 is set relative to impression cylinder 6 in the manner described previously.

In the illustrated embodiment, the plate cylinder setting mechanism 10 is operated in response to rotation of operating shaft 32 and movement of operating cam 33 so that the rubber blanket cylinder 1 is set relative to the plate cylinder 7 before it is set relative to impression cylinder 6. That is, the operation of coupling link 69 which couples cylinder setting arm 50 to the striking bar 16 as follows. When the rubber blanket cylinder 1 is set relative to plate cylinder 7 with the striking bar 16 driven downwardly by the end 38*b* of the arm or lever 38, as the force of compression of spring 72 is small, the cylinder setting arm 50 will not be rotated about the axis of stud shaft 52, the toggle mechanism 88 will not operate to set the rubber blanket cylinder 1 relative to impression cylinder 6.

Upon completion of the printing operation, the solenoid is deenergized causing link 2 to move upwardly due to the spring bias of spring 68 driving arm 63 clockwise to the position shown in FIG. 1 and to thereby operate striking bar 49, the result of which is to move the rubber blanket cylinder 1 away from the impression cylinder 6. In this operation, the cylinder setting arm 50 rotates clockwise, FIG. 1. Since the coupling link 69 is pivotally coupled by pin 98 to the cylinder setting arm 50, the coupling link moves upwardly, the toggle mechanism actuator link 54 moves downwardly and the result is that the rubber blanket cylinder 1 is moved away from the plate cylinder 7.

As may be appreciated from the above-described operation, the control or movement of the striking bars 16 and 49 are achieved through the compression spring coils 71 and 72 through which coupling link 69 passes with the link 69 being slidable through link boss 70 borne by striking bar 16.

Figure 3:
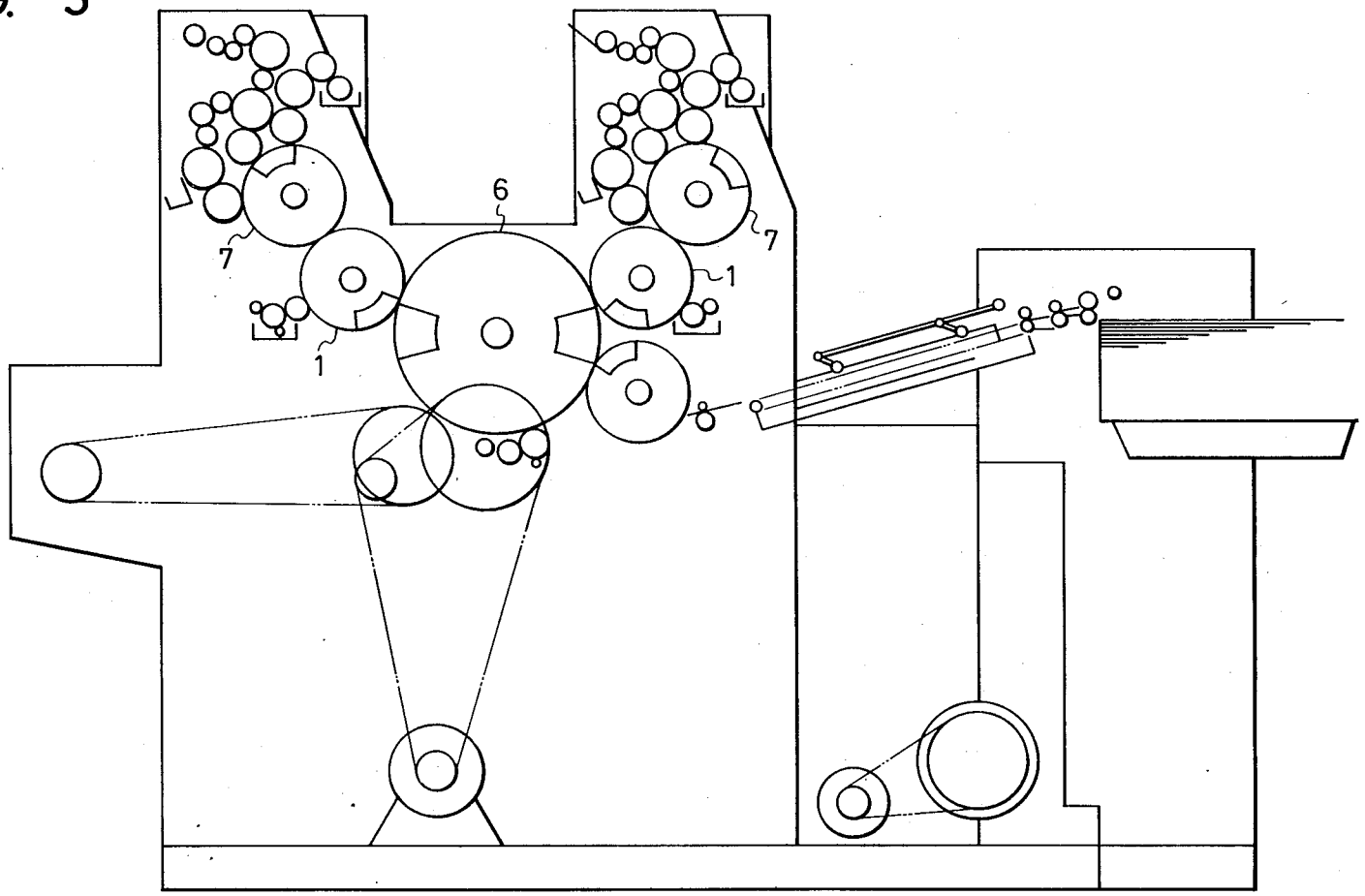
FIG. 3 is a schematic, side elevational view, illustrating a double-color offset printing machine to which the cylinder setting mechanism of the present invention has application.

Turning to FIG. 3, this illustrates the application of the present invention to a two-color printing machine in which dual mechanisms are arranged symmetrically with respect to the impression cylinder 6 to opposite sides thereof, and through the common impression 6, separate rubber blanket cylinder 1 and separate plate cylinder 7. However, the invention is not limited to a two-color printing machine and the technical concept of the invention may be effectively applied to a conventional single-color printing machine utilizing a single plate cylinder 7, rubber blanket cylinder 1 and impression cylinder 6.

To summarize, through the utilization of the cylinder setting mechanism of the present invention as described hereinabove, the rubber blanket cylinder 1 is brought into and out of engagement with the impression cylinder 6 and the plate cylinder 7, respectively, separately and in two steps. Thus, the rubber blanket cylinder is set initially relative to the plate cylinder 7 prior to setting of that rubber blanket cylinder relative to impression cylinder 6. The sequence is effected by timed operation of the impression of the plate cylinder setting cam 8 prior to that of the impression cylinder setting cam 9. As a result, therefore, it is possible that the rubber blanket cylinder 1 to be set relative to the plate cylinder 6 and the amount of ink to be transferred onto the rubber blanket cylinder 1 adjusted and thereafter the rubber blanket cylinder 1 shifted or set with respect to the impression cylinder 6. Therefore, the cylinder engagement and the adjustment of the quantity of ink to be transferred onto the rubber blanket cylinder can be controlled individually. Accordingly, it is unnecessary to use "spoil sheets" as in past practice to set up the print mechanism to effect acceptable printing by the offset print method. Furthermore, since the cylinder engagement or disengagement is carried out when the cuts of the cylinders are aligned with each other, the image is free from density variance. In addition, satisfactory prints can be obtained beginning with the first print and there are not wasted sheets. At the end of the printing operation, the striking bar 49 is shifted by energizing solenoid 61 so that the rubber blanket cylinder 1 is initially disengaged from the impression cylinder 6 and in the mechanism employed automatically, the rubber blanket cylinder 1 is then moved away from the plate cylinder 7. That is, the rubber blanket cylinder 1 may be automatically disengaged from both the impression cylinder 6 and the plate cylinder 7.

While the invention has been described in detail with respect to specific embodiments thereof, it will be apparent to one skilled in the art that modifications and changes can be made therein without departing from the spirit and scope thereof.

What is claimed is:

1. A cylinder setting mechanism for an offset printing machine, said offset printing machine comprising a frame, said frame including laterally spaced frame vertical walls, an impression cylinder mounted between said walls for rotation horizontally about a fixed axis on the frame, a plate cylinder mounted for rotation between said walls for rotation about a second fixed axis on the frame, parallel to the axis of rotation of the impression cylinder with the peripheries of the plate cylinder and the impression cylinder spaced from each other, and a rubber blanket cylinder interposed between the pressure cylinder and the plate cylinder, parallel thereto and between said frame vertical walls for peripheral contact with the plate cylinder and the impression cylinder, the improvement comprising, eccentric metal parts rotatably mounted on respective frame vertical walls for rotation about a first axis, an eccentric rubber blanket cylinder shaft extending between said frame vertical walls and mounted for rotation on said eccentric metal parts about an axis eccentric to the axis of rotation of said eccentric metal parts, and means for mounting said rubber blanket cylinder for rotation on said rubber blanket cylinder shaft about an axis which is eccentric to the axis of rotation of said eccentric rubber blanket cylinder shaft and means for selectively, sequentially rotating said eccentric metal parts and said eccentric rubber blanket cylinder shaft for sequentially setting said rubber blanket cylinder into engagement initially with said plate cylinder and subsequently with said impression cylinder in two steps.

2. The cylinder setting mechanism as claimed in claim 1, wherein said means for effecting selectively, sequential setting of said rubber blanket cylinder into engagement with said plate cylinder and said impression cylinder in two steps comprises a plate cylinder setting cam and an impression cylinder setting cam fixedly secured to the impression cylinder and rotating therewith and being angularly offset, a plate cylinder setting mechanism, an impression cylinder setting mechanism, said plate cylinder setting mechanism having a cylinder pressure adjusting mechanism including a first toggle mechanism coupled to said eccentric metal parts, a plate cylinder setting striking bar operatively positioned with respect to said plate cylinder setting cam and coupled to said first toggle mechanism such that the rubber blanket cylinder is brought into and out of engagement with said plate cylinder in response to operative engagement of the plate cylinder setting cam and said plate cylinder setting mechanism striking bar, said impression cylinder setting mechanism having a second cylinder pressure adjusting mechanism including a second toggle mechanism coupled to said eccentric rubber blanket cylinder shaft and an impression cylinder setting mechanism striking bar operatively positioned with respect to said impression cylinder setting cam, responsive thereto and coupled to said second toggle mechanism whereby said rubber blanket cylinder is brought into engagement with said impression cylinder individually and after setting of said rubber blanket cylinder into contact with said plate cylinder.

3. The cylinder setting mechanism as claimed in claim 2, wherein said plate cylinder setting mechanism further comprises a printing machine operating shaft extending between said frame vertical walls and mounted for rotation about its axis parallel to the axis of rotation of said cylinders, and a radial operating cam fixed to said operating shaft and rotating therewith, and cam follower means operatively coupled to said plate cylinder setting first toggle mechanism in the path of said radial cam and responsive to operating shaft rotation for setting the rubber blanket cylinder in contact with the plate cylinder without detection of a printing sheet such that, accordingly, the amount of the ink to be transferred onto the rubber blanket cylinder from the plate cylinder may be adjusted prior to initiation of printing operation with satisfactory prints obtained beginning with the first desired print.

4. The cylinder setting mechanism as claimed in claim 2, wherein said impression setting mechanism comprises a solenoid energizable in response to detection of a printing sheet supplied to the impression cylinder said solenoid including an axially movable plunger, a cylinder setting arm of said impression setting mechanism coupled to said striking bar of said plate cylinder setting mechanism through a coupling link, said coupling link being slidably mounted at one end through the center of a link boss fixed to said impression cylinder setting mechanism striking bar and compression springs concentrically surrounding said striking bar on opposite sides of said link boss and spring retainers mounted on said coupling link and abutting the ends of said springs remote from said link boss to maintain said springs under symmetrical compression, said coupling link having its opposite end thereof operatively connected to said solenoid plunger whereby, said rubber blanket cylinder is set into engagement with said plate cylinder prior to being set into engagement with said impression cylinder upon energization of said solenoid and wherein, deenergization of the solenoid results in automatic retraction of the rubber blanket cylinder from the impression cylinder and from the plate cylinder.

* * * * *